US005577801A

United States Patent [19]

Glockl

[11] Patent Number: 5,577,801

[45] Date of Patent: Nov. 26, 1996

[54] ACTIVE DYNAMIC SEAT

[76] Inventor: Josef Glöckl, Ammerseestrasse 6, D-8011 Kirchheim, Germany

[21] Appl. No.: 150,106

[22] PCT Filed: Mar. 29, 1993

[86] PCT No.: PCT/EP93/00759

§ 371 Date: Feb. 10, 1994

§ 102(e) Date: Feb. 10, 1994

[87] PCT Pub. No.: WO93/19648

PCT Pub. Date: Oct. 14, 1993

[30] Foreign Application Priority Data

Mar. 27, 1992 [DE] Germany ..... 42 10 134.4

[51] Int. Cl.[6] ..... A47C 1/02

[52] U.S. Cl. ..... 297/201; 297/209; 297/312; 297/258.1

[58] Field of Search ..... 297/195.1, 195.11, 297/195.12, 196, 201, 208–210, 232, 248, 258, 311, 312, 313, 272, 258.1, 272.1, 440.1, 452.21, 452.23, 452.26, 452.27, 452.48, 452.49, 452.5, 452.55; 248/615, 581

[56] References Cited

U.S. PATENT DOCUMENTS

| | | | |
|---|---|---|---|
| 2,132,291 | 10/1938 | Fitos . | |
| 2,799,323 | 7/1957 | Berg . | |
| 3,749,442 | 7/1973 | Berg et al. | 297/312 |
| 5,024,485 | 6/1991 | Berg et al. | 297/312 |
| 5,288,127 | 2/1994 | Berg et al. | 297/312 |

FOREIGN PATENT DOCUMENTS

| | | | |
|---|---|---|---|
| 2905065 | 2/1980 | Germany | 297/312 |
| 3513985 | 10/1986 | Germany | 297/313 |
| 90144899 | 10/1990 | Germany . | |
| 560657 | 4/1957 | Italy | 297/196 |

*Primary Examiner*—Milton Nelson, Jr.
*Attorney, Agent, or Firm*—Birch, Stewart, Kolasch & Birch, LLP.

[57] ABSTRACT

An active dynamic seat has a base, an intermediate piece linked to the base and a seating part linked to the intermediate piece. The seating part is made of two pieces. The two halves of the seating part are resiliently linked in the vertical direction to the intermediate piece, independently from each other, and have each a support part and a seating half arranged thereon. Each seating half of a seating part half is mounted so as to tilt backwards and forwards on the support part.

12 Claims, 4 Drawing Sheets

ACTIVE DYNAMIC SEAT

The invention relates to an active dynamic seat.

BACKGROUND OF THE INVENTION

Conventional seating furniture is designed in most cases so that the body, especially the back, is supported by correspondingly fashioned seating surfaces and backs in an anatomically maximally favorable position. Although such seating furniture is frequently felt to be comfortable, there is the decisive drawback that the body sits merely passively on such seats, i.e. the back muscles are hardly stressed, and the intervertebral disks are stressed merely statically in the "pressure mode". As a result, a long-term usage of such seat furnishings leads to degeneration of the back muscles and wasting of the intervertebral disks. Impairment of health and pains in the back and hip regions (e.g., sciatica) are the frequent consequence of such static and passive sitting.

For this reason, seating furnishings have been developed permitting a so-called active dynamic sitting wherein the back musculature and the intervertebral disks are constantly slightly active. This active dynamic sitting attitude is attained in practically all cases by maintaining the actual seat of the seating furniture in a labile position and making it optionally additionally resilient in the vertical direction.

Such an active dynamic seating device has been described, for example, in DE 73 11 140. This seat consists essentially of a seat part connected via a first tilting joint with a supporting shank, the latter, in turn, being articulated by means of a second tilting joint to the base of the seating device. In this arrangement, each tilting joint consists preferably of a cap formed respectively at the end of the supporting shank, this cap being guided in a hollow cylinder and stressed by a coil spring arranged in the hollow cylinder.

On account of the planar structure of the underside of the cap, the latter is in contact, in the non-stressed condition, with the bottom or, respectively, top of the hollow cylinder so that, without stress, a perfect alignment is achieved of base, supporting shank, and seat. When stress is exerted on this seating device, the two coil springs of the tilting joints are compressed, the two caps being urged into the two hollow cylinders. The tilting movement of these two joints is attained by the feature that the bore in the top of the lower cylinder or, respectively, in the bottom of the upper hollow cylinder is slightly larger than the outer diameter of the supporting shank.

However, the disadvantage arises herein that the maximally possible tilting angle of each tilting joint in the stressed condition is dependent on the distance of the planar side of the cap from the bottom or top of the hollow cylinder and thus on the weight of the person presently using this seating device. Moreover, it is extremely difficult to maintain one's balance on this seating device so that, at least for inexperienced users, there must be the possibility that at least one of the tilting joints is blocked. This results from the fact that, upon deflection of the tilting joint at the base of the seating device into a specific direction, a deflection of the upper tilting joint in the same direction takes place in a preferred manner.

SUMMARY OF THE INVENTION

The invention is based, therefore, on the object of providing an active dynamic seat ensuring, on the one hand, a seating position active to an adequate extent and, on the other hand, permitting a harmless use of the seating device even without a prolonged training phase and/or familiarization phase.

Moreover, the invention is based on the task of creating an active dynamic seat that can be produced in a simple and economical way.

The invention attains this object with the characterizing features of claim 1.

A labile equilibrium for the seated person is ensured by the division of the seat part into two seat parts halves connected independently of each other in a vertically resilient fashion with the intermediate piece of the seating device, and by the forwardly and rearwardly tiltable connection of each seat half of a seat part half with a supporting part. Thus, an active dynamic seating position results without any appreciable transverse movements of the seat part so that the seating device of this invention can be utilized even by inexperienced users without any long training or familiarization phase.

In a further embodiment, the seat part halves are connected to the intermediate piece by way of respectively one parallel double rocker arm, the latter being engaged by a device for restoration into the neutral position. The restoring device can here be designed, in particular, as a correspondingly located tension or compression spring, Additional embodiments of the invention can be seen from the dependent claims.

BRIEF DESCRIPTION OF THE DRAWINGS

The invention will be described in greater detail below with reference to embodiments illustrated in the drawings wherein:

FIG. 3(*d*) is a cross-section of the seat of FIG. 3(*b*) showing a core within the seat along a section line III(D)—III(D).

DETAILED DESCRIPTION OF THE EMBODIMENTS

Figure 1:
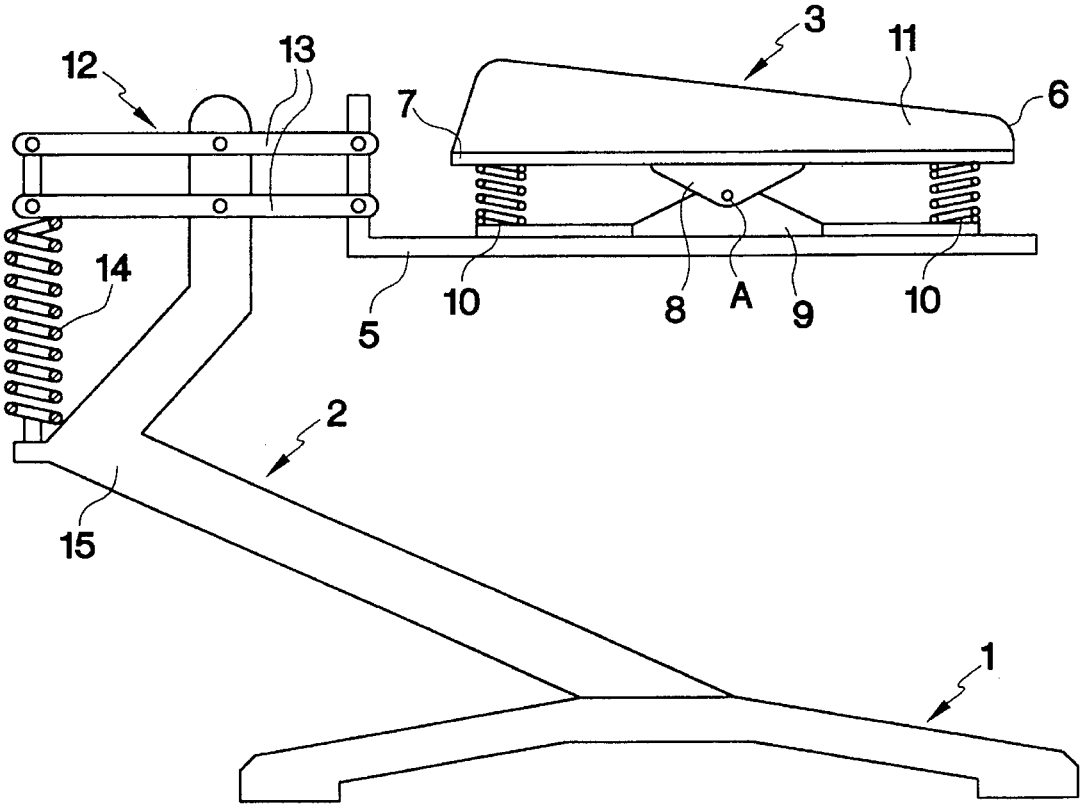
FIG. 1 is a lateral view of a schematically shown embodiment of the seating device according this invention.

The embodiment of the active dynamic seat shown in FIG. 1 consists of a base 1, an intermediate piece 2 connected thereto, and a seat part 3.

The base 1 exhibits, as is known, several feet arranged in stellate fashion and integrally connected at their inner ends.

With the central zone of the base 1, formed in this way, the lower end of the intermediate piece 2 is connected, the seat part 3 being attached to the upper end of this piece. The seat part 3, for safety reasons, must here be located substantially in a position above the central zone of the base 1. In case the seat part 3, as illustrated in FIG. 1, is attached merely at its rear side to the intermediate piece 2, then the intermediate piece 2 must be suitably designed.

Figure 2:
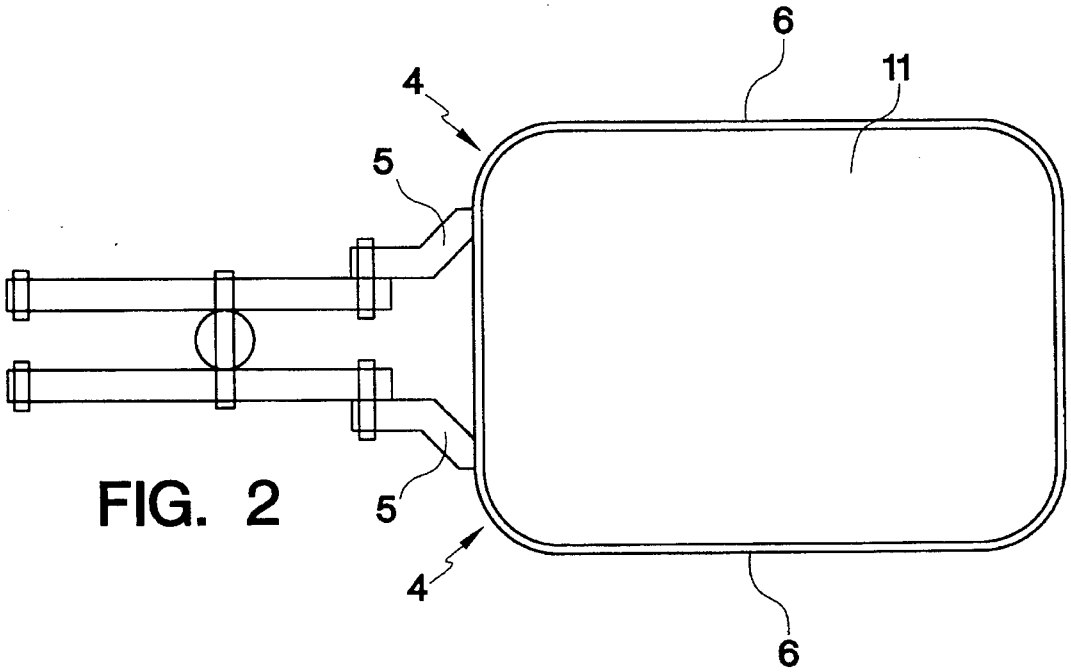
FIG. 2 is a partial top view of the seating device in FIG. 1.
Figure 3A:
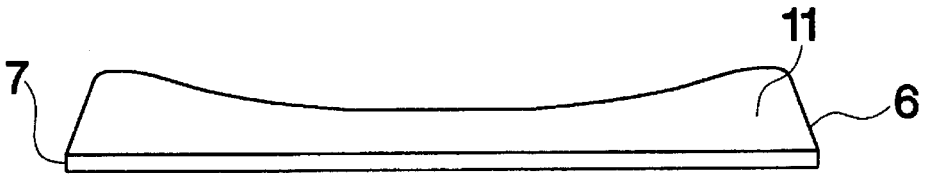
FIGS. 3(*a*), 3(*b*), and 3(*c*) are lateral views, of the seat in concave shape, convex shape, and planar shape, respectively.
Figure 3B:
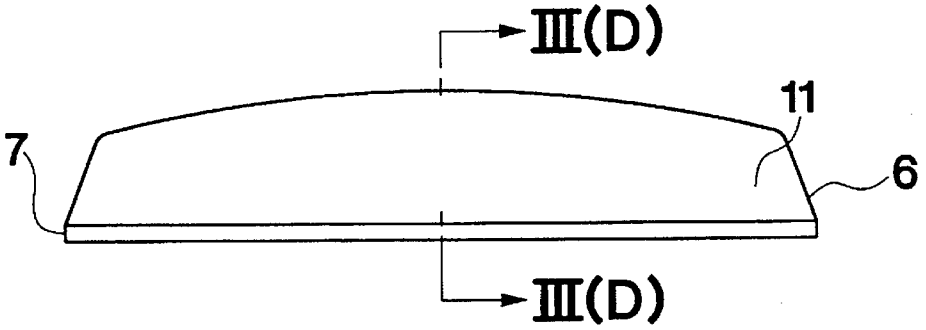
Figure 3C:
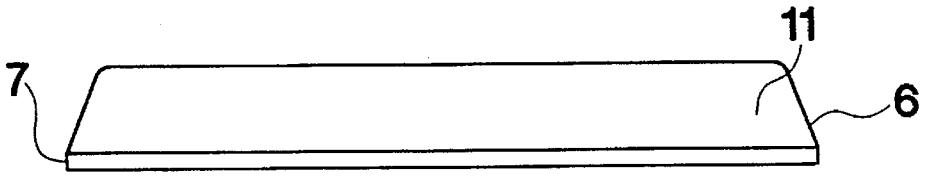
Figure 3D:
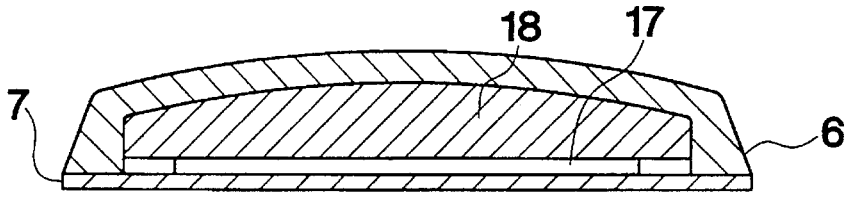

As can be seen from the schematic top view of the seating device according to this invention of FIG. 1, illustrated in FIG. 2, the seat part 3 is constructed to be bipartite, consisting of two seat part halves 4. The seat part halves 4 each comprise a supporting part 5, a seat half 6 being arranged on this supporting part to be pivotable forwardly and rearwardly about an axis A.

For this purpose, as illustrated in FIG. 1, each plate 7 of a seat half 6 can have on the underside, e.g., a first bearing part 8 pivotably connected with a second bearing part 9 arranged on the supporting part 5 by means of an axle engaging into corresponding bores. In order to ensure the restoring of the unstressed seat part or the unstressed seat halves into the neutral position, restoring devices must be provided which engage at the seat halves 6. In the embodiment of the invention shown in FIG. 1, these restoring devices are fashioned as tension or compression springs 10 which are arranged in each case before and, respectively, behind the axis A between the supporting parts 5 and the plates 7 of the seat halves 6. The springs 10 are, of course, fixed in their position by means of retaining devices, not shown in detail, and can moreover be connected with the plats 7 and/or the supporting parts 5.

Figure 4:
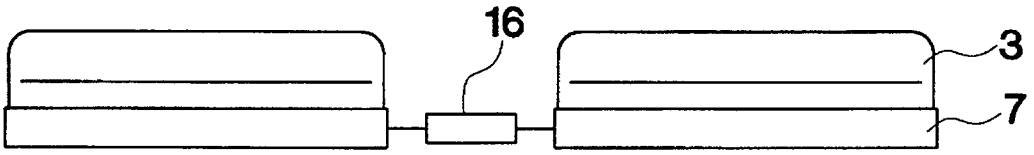
FIG. 4 shows an end view of the plates of the seat halves being selectively affixed.
Figure 5:
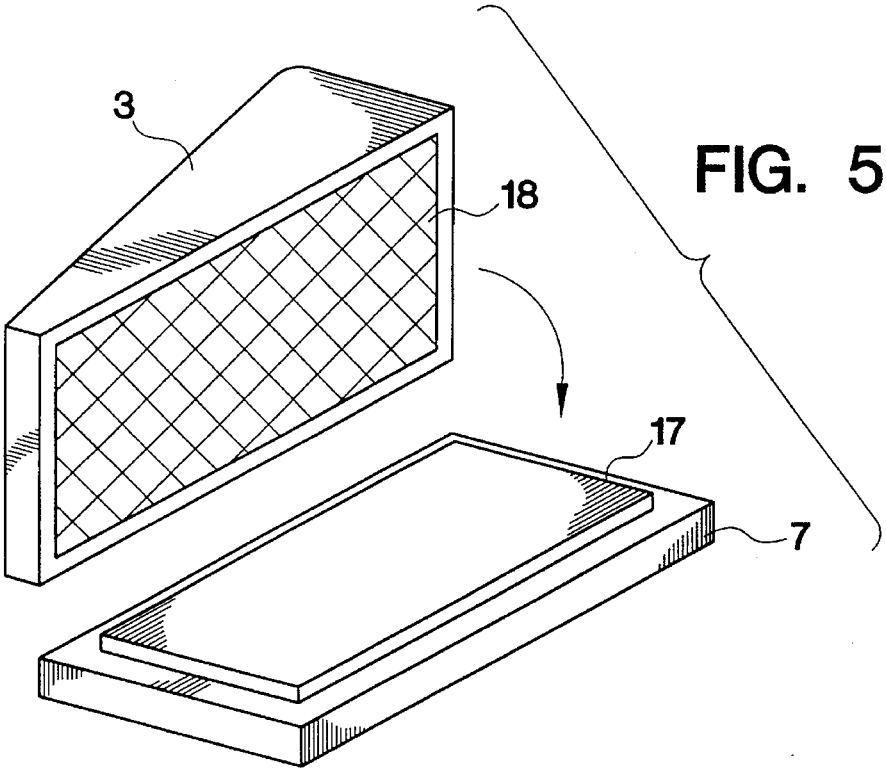
FIG. 5 shows a means for selectively affixing a seat cushion to a seat half.

Respectively one seat cushion 11 is arranged on the plates 7. The seat cushion 11 can consist, for example, of fabric-covered foam material, a core structure 18 as shown in FIG. 4, and can be connected to the plate 7 optionally fixedly or releasably, as by known conventional selective fixing means 17, shown by a block in FIG. 5. In order to promote an anatomically favorable sitting attitude, the seat cushion 11 can be designed to be convex, concave, planar, or wedge-shaped. In case of a wedge-shaped design, the higher end of the wedge should be located in the back of the seated person. The concave, convex and planar shapes are shown in FIG. 3(*a*), 3(*b*) and 3(*c*), respectively. The seat cushion 11 has a core structure 18 (see FIG. 3(*d*)) which is substantially dimensionally stable even under load.

Moreover, the seat cushions 11 and/or the plates 7 can be joined flexibly with each other as by known conventional flexible connecting means 16 (e.g. an elastic material or device) shown as a block in FIG. 4; in particular, a correspondingly flexible, one-piece seat cushion 11 can be utilized, as shown in FIG. 2.

The mounting of the seat part halves 4 to the intermediate piece 2 is effected in the embodiment of the invention shown in FIG. 1 by means of respectively one of the parallel double rocker arms 12. The parallel double rocker arms 12 consist of respectively two rocker arms 13 rotatably supported at a predetermined mutual spacing in the upper end of the intermediate piece 2. The ends of these rocker arms facing the seat part 3 are in each case rotatably connected to the supporting parts 5 at the same mutual spacing. For this purpose, the ends of the supporting parts 5 facing the intermediate piece 2 are angled at a right angle so that these ends extend in parallel to the upper end of the intermediate piece 2.

However, for a functioning of these parallel double rocker arms 12 arranged respectively on one side of the intermediate piece 2, it is merely necessary to arrange the respectively four fulcrums in the form of a parallelogram.

The other ends of the two rocker arms 13 of each parallel double rocker arm 12 are connected each to a tension spring 14, the lower ends to the latter being connected to the intermediate piece 2 in the zone of a knee 15 designed for this purpose. The seat part halves 4 are consequently supported independently of each other to be resilient essentially in the vertical direction by the system consisting of the double parallel rocker arms 12 and the tension springs 14. A labile equilibrium results for the seated person in conjunction with the likewise independently possible pivoting of the seat halves 6 about the axis A; the characteristic of this equilibrium is determined by the dimensioning of the tension springs 14 or, respectively, the compression or tension springs 10.

The teaching of this invention, namely to design the seat part 3 to be bipartite and to fashion each seat part half to be resilient substantially in the vertical direction and also to fashion the seat halves to be pivotable about an axis, can, of course, also be realize in another way: For example, the supporting parts 5 of the seat part halves 4 can each be connected with pneumatically resilient cylinders which are retained on a substantially vertically extending intermediate piece 2.

Moreover, the base 1 can assume any other desired shape ensuring the stability and thus safety of the seating device. Additionally, several casters can be located at the base 1 in a manner known per se in order to permit an easy displacement of the seating device.

Figure 7:
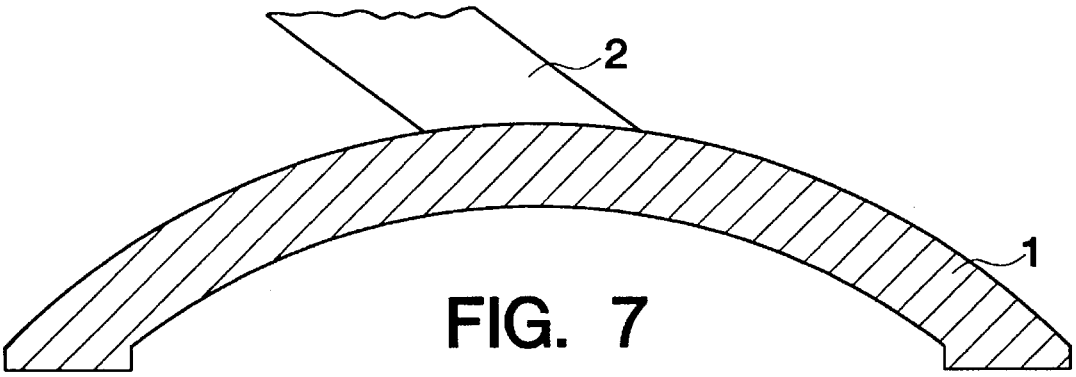
FIG. 7 shows another example of a supporting bearing portion which is curved downwardly in convex fashion.

Furthermore, the base 1 can exhibit a bearing portion that is curved downwardly in a slightly convex fashion, likewise facilitating the displacement of the seating device on account of the smaller contact surface as shown in FIGS. 1 and 7. Additionally, it has been found that such a very slight curvature of the contact surface—with a diameter of the base of about 50 cm to 60 cm, the marginal zone should have a spacing of about 0.5 cm to 1 cm from a planar contact surface—has a positive effect on the desired active dynamic sitting attitude.

Figure 6:
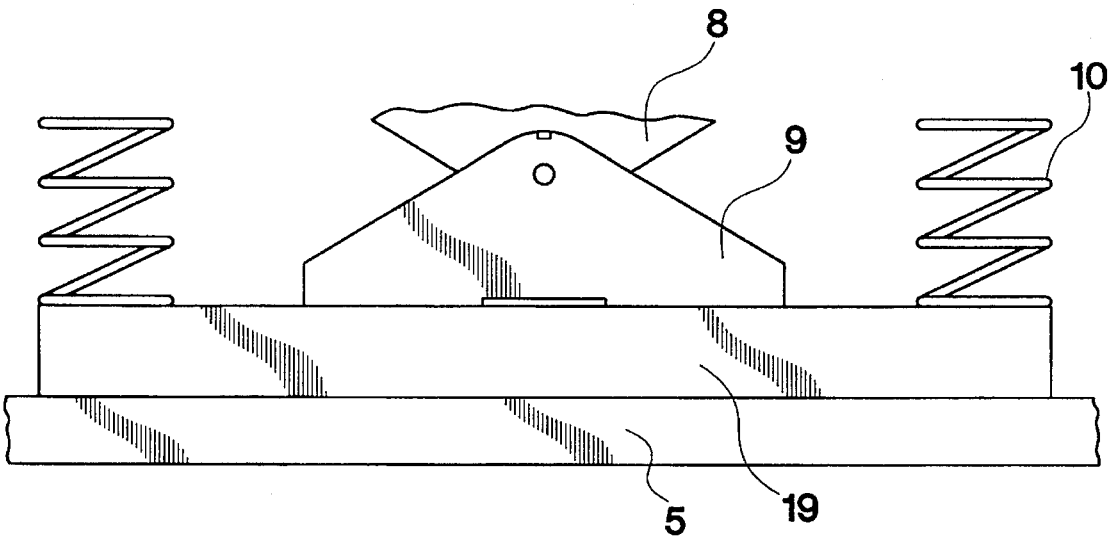
FIG. 6 shows a means for laterally deflecting the seat half in a forward and rearward direction.

Finally, each set half 6 of the seat part halves 4 can be arranged on the supporting part 5 to be displaceable in the forward and rearward directions, whereby a further possibility of motion in a transverse direction is added, beyond the pivoting motion about pivot A. In this arrangement, the deflection in the forward and rearward directions from the neutral position can take place against a restoring force provided by known conventional spring means 19. This motion is not to be confused with the rotational motion about pivot A shown in FIG. 1. Herein, the deflection is in a forward/reverse deflection, left/right as shown in FIG. 6 whereat such movement is against the spring force of spring means 19.

I claim:

1. An active dynamic seat comprising:

a base;

an intermediate piece having an upper end and a lower end, the lower end being connected to the base;

a seat part; and connection means for connecting the intermediate piece to the seat part; wherein the seat part includes two seat halves, the seat halves being connected separately by the connection means, substantially vertically resiliently to the intermediate piece, each seat half including a plate and a supporting part, the plate being pivotably supported on the supporting part to be tiltable in forward and rearward directions, wherein the connection means include a pair of parallel double rocker arms, one of the pair of parallel double rocker arms connecting each supporting part to the intermediate piece, and a first spring means for biasing each parallel double rocker arm.

2. The seat according to claim 1, wherein the base further includes a supporting bearing portion, the portion being slightly curved downwardly in convex fashion.

3. The seat according to claim 1, wherein each seat half further includes a seat spring means disposed between the plate and the supporting part for restoring deflection in the forward and rearward directions to a neutral position.

4. The seat according to claim 3, wherein the base further includes a supporting bearing portion, the portion being slightly curved downwardly in convex fashion.

5. The seat according to claim 1, wherein the seat part further includes a seat cushion selected from a group consisting of a flexible, one-piece seat cushion and a two-piece seat cushion, said seat cushion being disposed on the two seat halves.

6. The seat according to claim 5, wherein each seat half further includes a seat spring means disposed between the plate and the supporting part for restoring deflection in the forward and rearward directions to a neutral position.

7. The seat according to claim 5, wherein said seat cushion has a core structure, said core structure being substantially dimensionally stable even under load.

8. The seat according to claim 1, wherein the two seat halves are flexibly connected with each other.

9. The seat according to claim 8, wherein each seat half further includes a seat spring means disposed between the plate and the supporting part for restoring deflection in the forward and rearward directions to a neutral position.

10. The seat according to claim 8 wherein each seat half includes a seat cushion, each said seat cushion being releasably connected to the corresponding seat half, the seat cushion having a shape selected from the group consisting of planar, convex, concave, and wedge.

11. The seat according to claim 8, wherein each seat half includes a seat cushion, each said seat cushion being fixedly connected to the corresponding seat half, the seat cushion having a shape selected from the group consisting of planar, convex, concave, and wedge.

12. The seat according to claim 11, wherein said seat cushion has a core structure, said core structure being substantially dimensionally stable even under load.

* * * * *